US012617054B2

(12) United States Patent
Nakano et al.

(10) Patent No.: US 12,617,054 B2
(45) Date of Patent: May 5, 2026

(54) CREEP FEED GRINDING APPARATUS

(71) Applicant: DISCO CORPORATION, Tokyo (JP)

(72) Inventors: Keisuke Nakano, Tokyo (JP); Satoshi Yamanaka, Tokyo (JP); Ryo Shimazu, Tokyo (JP)

(73) Assignee: Deckers Outdoor Corporation, Goleta, CA (US)

( * ) Notice: Subject to any disclaimer, the term of this patent is extended or adjusted under 35 U.S.C. 154(b) by 274 days.

(21) Appl. No.: 18/053,855

(22) Filed: Nov. 9, 2022

(65) Prior Publication Data

US 2023/0158628 A1 May 25, 2023

(30) Foreign Application Priority Data

Nov. 22, 2021 (JP) ..... 2021-189224

(51) Int. Cl.
*B24B 7/02* (2006.01)
*B24B 7/22* (2006.01)
(Continued)

(52) U.S. Cl.
CPC ..... *B24B 7/02* (2013.01); *B24B 7/228* (2013.01); *B24B 41/005* (2013.01); *B24B 53/007* (2013.01); *B24B 53/12* (2013.01)

(58) Field of Classification Search
CPC ..... B24B 53/00; B24B 53/007; B24B 53/017; B24B 53/12; B24B 53/095; B24B 55/02; B24B 7/02; B24B 7/228
See application file for complete search history.

(56) References Cited

U.S. PATENT DOCUMENTS

2002/0173228 A1* 11/2002 Gunjima ..... B23K 26/032 125/11.01
2010/0285723 A1* 11/2010 Lin ..... B24B 57/02 451/36

(Continued)

FOREIGN PATENT DOCUMENTS

JP 2004351561 A 12/2004
JP 2010103192 A 5/2010

(Continued)

OTHER PUBLICATIONS

Japan Patent Application No. 2021-189224: English translation of Office Action, May 27, 2025 (2 pages).

*Primary Examiner* — Carlos A. Rivera
(74) *Attorney, Agent, or Firm* — Greer, Burns & Crain, Ltd.

(57) ABSTRACT

A creep feed grinding apparatus includes a chuck table, a grinding unit having a spindle and a grinding wheel mounted on a lower end of the spindle, the grinding wheel including a plurality of grindstones disposed in an annular array on a surface of an annular base, the grindstones following an annular track upon rotation of the spindle, a moving mechanism for moving the chuck table and the grinding unit relative to each other along a predetermined direction perpendicular to the longitudinal axis of the spindle, and a bottom surface state adjusting mechanism for adjusting states of bottom surfaces of the grindstones by cleaning and/or correcting the bottom surfaces of the grindstones. The bottom surface state adjusting mechanism is positioned outside of a relative movement area of the chick table in which the chuck table and the grinding unit are moved relative to each other by the moving mechanism.

10 Claims, 12 Drawing Sheets

(51) Int. Cl.

| | |
|---|---|
| ***B24B 41/00*** | (2006.01) |
| ***B24B 53/007*** | (2006.01) |
| ***B24B 53/12*** | (2006.01) |

(56) References Cited

U.S. PATENT DOCUMENTS

| | | | | |
|---|---|---|---|---|
| 2018/0236630 | A1* | 8/2018 | Yasuda | B24B 53/017 |
| 2019/0061109 | A1* | 2/2019 | Takenouchi | B24B 7/241 |

FOREIGN PATENT DOCUMENTS

| | | | | | |
|---|---|---|---|---|---|
| JP | 2015160251 | A | | 9/2015 | |
| JP | 2017030071 | A | * | 2/2017 | B24B 53/017 |
| JP | 2017154186 | A | | 9/2017 | |
| JP | 2017154238 | A | | 9/2017 | |
| JP | 2018062051 | A | | 4/2018 | |
| JP | 2020078849 | A | | 5/2020 | |
| JP | 2020093318 | A | * | 6/2020 | |
| KR | 20170086310 | A | * | 7/2017 | |

* cited by examiner

CREEP FEED GRINDING APPARATUS

BACKGROUND OF THE INVENTION

Field of the Invention

The present invention relates to a creep feed grinding apparatus for grinding a workpiece with a grinding wheel while a grinding unit having a spindle with the grinding wheel mounted on a lower end thereof and a chuck table holding the workpiece under suction thereon are being moved relative to each other in a direction perpendicular to the longitudinal axis of the spindle.

Description of the Related Art

Pieces of electronic equipment such as cellular phones and personal computers typically incorporate device chips having such devices as integrated circuits (ICs). Device chips are manufactured as follows: First, a plurality of projected dicing lines or streets are established in a grid pattern on the face side of a wafer made of a semiconductor such as silicon, and devices are formed in respective rectangular areas demarcated on the face side of the wafer by the projected dicing lines. Then, a cutting apparatus is used to cut the wafer along the streets into individual pieces as device chips. In recent years, it has been customary to grind the reverse side of a wafer after devices have been formed on the face side thereof, thereby reducing the finished thickness of device chips to be produced from the wafer, with a view to reducing the size and weight of the device chips.

Wafers are ground using a creep feed grinding apparatus, for example (see Japanese Patent Laid-open No. 2010-103192). The creep feed grinding apparatus includes a chuck table having a holding surface for holding a workpiece, i.e., a wafer, under suction thereon. The creep feed grinding apparatus also includes a grinding unit disposed above the holding surface. The grinding unit has a cylindrical spindle whose longitudinal axis extends substantially perpendicularly to the holding surface. Usually, the longitudinal axis of the spindle lies substantially parallel to a Z-axis of the creep feed grinding apparatus, e.g., a vertical axis. The spindle has a lower end on which there is mounted an annular grinding wheel by a circular plate mount interposed therebetween.

The grinding wheel has an annular base whose lower surface supports thereon an annular array of grindstones spaced at substantially equal intervals along circumferential directions of the annular base. When the spindle is rotated about its central axis, i.e., its longitudinal axis, the grinding wheel is also rotated about its central axis, enabling the grindstones to provide an annular grinding surface along an annular track made up of the lower surfaces of the grindstones as they rotate in unison with the grinding wheel. In order for the creep feed grinding apparatus to operate in a creep feed grinding mode, the workpiece has its face side held under suction on the holding surface with its reverse side exposed upwardly, and the grinding unit is adjusted in its vertical position or height such that the annular grinding surface is slightly lower than the exposed reverse side of the workpiece. Then, the chuck table is moved along an X-axis perpendicular to the Z-axis to cause the grindstones to grind the reverse side of the workpiece in the creep feed grinding mode.

In the creep feed grinding mode, the load applied along the X-axis to the outer side surfaces of the grindstones tends to be larger than the load applied along the Z-axis to bottom surfaces of the grindstones. By contrast, in an in-feed grinding mode in which the grinding unit is processing-fed downwardly along the Z-axis while the chuck table disposed below the grinding unit is being rotated, the load applied along the Z-axis to the bottom surfaces of the grindstones tends to be larger than the load applied along the X-axis to the outer side surfaces of the grindstones.

In the creep feed grinding mode, depending on the loads applied to the grindstones when the workpiece is ground, the bottom surfaces of the grindstones are liable to wear to a smaller extent than the bottom surfaces of the grindstones liable to wear in the in-feed grinding mode. In the creep feed grinding mode, hence, the bottom surfaces of the grindstones are likely to suffer a grindstone condition failure or malfunction such as grindstone loading. In particular, the bottom surfaces of the grindstones are more likely to suffer a grindstone condition failure when the grindstones grind a substrate of resin in the creep feed grinding mode.

SUMMARY OF THE INVENTION

Such a grindstone condition failure may be eliminated by a dressing step of dressing the grindstones in addition to a grinding step of grinding the workpiece in the creep feed grinding mode. However, the additional dressing step lowers the efficiency of grinding in the creep feed grinding mode.

The present invention has been made in view of the above difficulties. It is an object of the present invention to provide a creep feed grinding apparatus that is capable of eliminating a grindstone condition failure at the bottom surfaces of grindstones without lowering the efficiency of grinding.

In accordance with an aspect of the present invention, there is provided a creep feed grinding apparatus including a chuck table having a holding surface for holding a workpiece under suction thereon, a grinding unit having a spindle rotatable about a longitudinal axis thereof and a grinding wheel mounted on a lower end of the spindle, the grinding wheel including an annular base and a plurality of grindstones disposed in an annular array on a surface of the annular base, the grindstones following an annular track upon rotation of the spindle, the annular track having an outside diameter larger than the diameter of the chuck table, a moving mechanism for moving the chuck table and the grinding unit relatively to each other along a predetermined direction perpendicular to the longitudinal axis of the spindle, and a bottom surface state adjusting mechanism for adjusting states of bottom surfaces of the grindstones by cleaning or correcting or cleaning and correcting the bottom surfaces that are held in contact with the workpiece on the holding surface when the grinding unit grinds the workpiece in a creep feed grinding mode, the bottom surface state adjusting mechanism being positioned outside of a relative movement area of the chuck table in which the chuck table and the grinding unit are moved relative to each other by the moving mechanism.

Preferably, the bottom surface state adjusting mechanism has a first nozzle for ejecting high-pressure water to the bottom surfaces of the grindstones when the grinding unit grinds the workpiece in the creep feed grinding mode.

Preferably, the bottom surface state adjusting mechanism has a second nozzle for ejecting high-pressure water including abrasive grains to the bottom surfaces of the grindstones when the grinding unit grinds the workpiece in the creep feed grinding mode.

Preferably, the bottom surface state adjusting mechanism has a third nozzle for ejecting a two-fluid mixture of water and air to the bottom surfaces of the grindstones when the grinding unit grinds the workpiece in the creep feed grinding mode.

Preferably, the bottom surface state adjusting mechanism has a dresser for contact with the bottom surfaces of the grindstones when the grinding unit grinds the workpiece in the creep feed grinding mode.

Preferably, the bottom surface state adjusting mechanism has a brush for contact with the bottom surfaces of the grindstones when the grinding unit grinds the workpiece in the creep feed grinding mode.

Preferably, the bottom surface state adjusting mechanism has a laser beam applying unit including a beam condenser for applying a laser beam to the bottom surfaces of the grindstones when the grinding unit grinds the workpiece in the creep feed grinding mode.

The creep feed grinding apparatus according to the aspect of the present invention includes the bottom surface state adjusting mechanism. The bottom surface state adjusting mechanism is positioned outside of the relative movement area of the chuck table in which the chuck table and the grinding unit are moved relative to each other by the moving mechanism. The bottom surface state adjusting mechanism adjusts the states of the bottom surfaces of the grindstones by cleaning or correcting or cleaning and correcting the bottom surfaces that are held in contact with the workpiece on the holding surface when the grinding unit grinds the workpiece in the creep feed grinding mode. For example, when the grinding unit grinds the workpiece in the creep feed grinding mode, the bottom surface state adjusting mechanism eliminates a grindstone condition failure or malfunction such as grindstone loading by cleaning and/or correcting the bottom surfaces of the grindstones that are positioned outside of the chuck table. Consequently, a grindstone condition failure of the bottom surfaces of the grindstones can be eliminated without a reduction in the efficiency of grinding in the creep feed grinding mode.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 1:
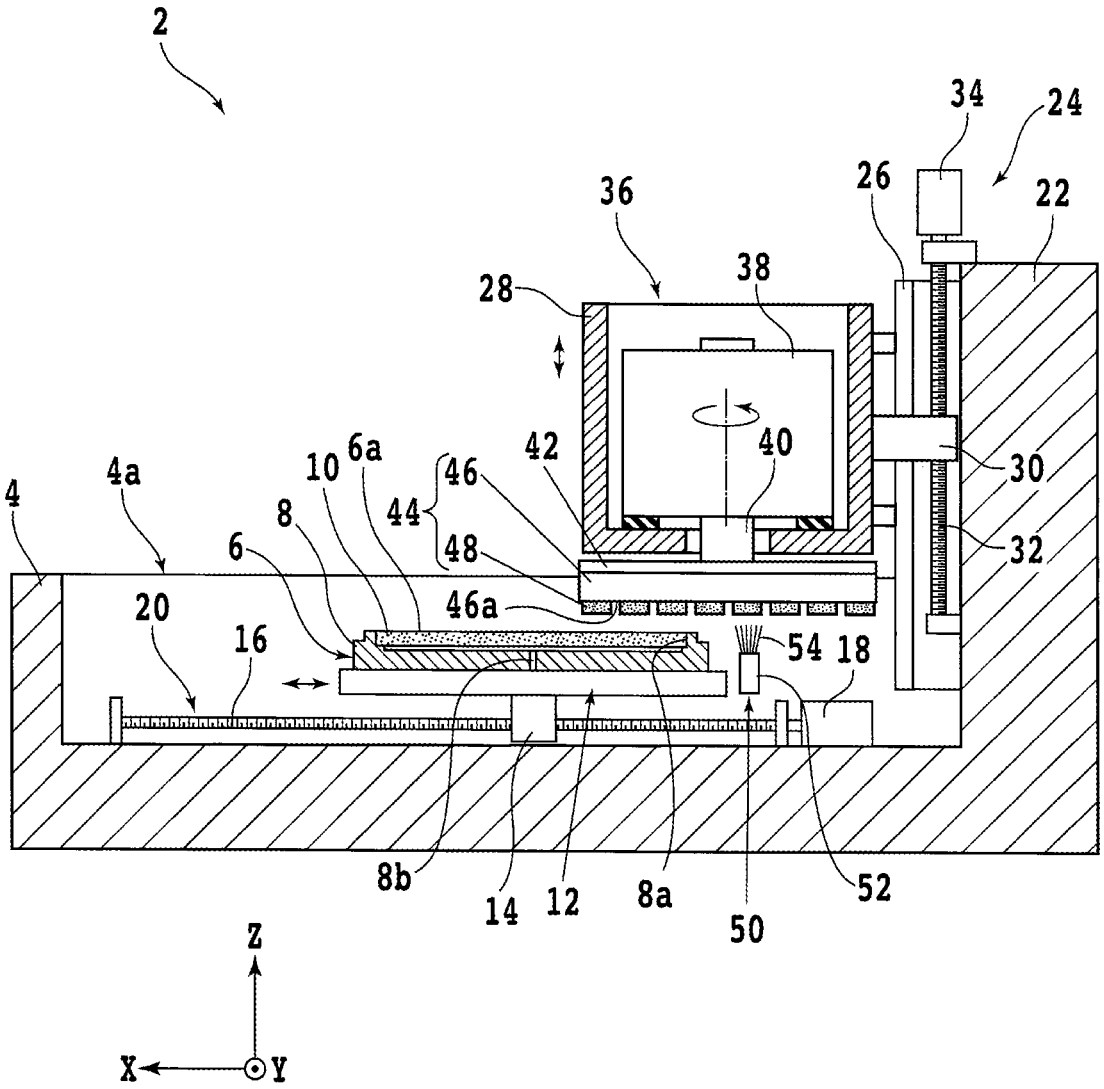
FIG. 1 is a side elevational view, partly in cross section, of a creep feed grinding apparatus according to a first embodiment of the present invention.

Preferred embodiments of the present invention will be described in detail below with reference to the accompanying drawings. Identical or similar components are denoted by identical or similar reference characters throughout views. Throughout the drawings, creep feed grinding apparatuses according to the preferred embodiments are illustrated in reference to a three-dimensional coordinate system having X-, Y-, and Z-axes indicated respectively by the arrows X, Y, and Z. The X-axis and the Y-axis lie on a horizontal plane, whereas the Z-axis extends vertically perpendicularly to the horizontal plane. X-axis directions, i.e., forward and rearward directions, extend parallel to the X-axis, and Y-axis directions, i.e., leftward and rightward directions, extend parallel to the Y-axis. Z-axis directions, i.e., upward and downward directions, extend parallel to the Z-axis perpendicular to the X-axis and the Y-axis.

FIG. 1 illustrates by way of example, in side elevation, partly in cross section, a creep feed grinding apparatus 2 according to a first embodiment of the present invention. As illustrated in FIG. 1, the creep feed grinding apparatus 2 includes a base 4 supporting thereon and housing therein various components of the creep feed grinding apparatus 2. The base 4 has a recess 4*a* defined in the shape of a rectangular parallelepiped in an upper portion thereof and opening upwardly. The recess 4*a* has a longitudinal axis extending along the X-axis.

A circular plate chuck table 6 is movably disposed in the recess 4*a*. The chuck table 6 has a circular plate frame 8 that is made of ceramic and that has a circular plate cavity 8*a* defined in an upper portion thereof and opening upwardly. A circular plate porous plate 10 made of porous ceramic is fixedly disposed in the cavity 8*a*. The frame 8 and the porous plate 10 have respective upper surfaces lying substantially flush with each other and jointly providing a holding surface 6*a* lying substantially parallel to the X-axis and the Y-axis. The frame 8 has a fluid channel 8*b* that is defined therein and that fluidly connects the porous plate 10 to an unillustrated suction source, such as an ejector. When a negative pressure generated by the suction source is transmitted through the fluid channel 8*b* to the porous plate 10, a workpiece 11 (see FIG. 2) that is placed on the holding surface 6*a* is held under suction on the holding surface 6*a* under the negative pressure applied to the porous plate 10. The chuck table 6 is supported on a rectangular X-axis movable plate 12.

The X-axis movable plate 12 is slidably supported on a pair of unillustrated guide rails disposed in the recess 4*a* and extending substantially parallel to the X-axis. A nut 14 is fixedly mounted on a lower surface of the X-axis movable plate 12 and operatively threaded over a screw shaft 16 rotatably disposed between the guide rails and extending along the X-axis. The screw shaft 16 has an end connected to a rotary actuator 18 such as an electric motor for rotating the screw shaft 16 about its central axis. When the rotary actuator 18 is energized, it rotates the screw shaft 16 about its central axis, causing the nut 14 to move the chuck table 6 along the X-axis. The X-axis movable plate 12, the nut 14, the screw shaft 16, the rotary actuator 18, etc., jointly make up an X-axis moving mechanism 20 for moving the chuck table 6 along the X-axis.

The creep feed grinding apparatus 2 includes a support structure 22 shaped as a rectangular parallelepiped protruding upwardly from one end of the base 4 beyond the opening of the recess 4*a* rearwardly of the X-axis moving mechanism 20 in one of the X-axis directions. The support structure 22 is integrally combined with the base 4, and supports a Z-axis moving mechanism 24 on a front surface thereof facing in the other of the X-axis directions. The Z-axis moving mechanism 24 is fixedly mounted on the front surface of the support structure 22 and includes a pair of guide rails 26 extending parallel to each other vertically along the Z-axis. A hollow cylindrical bottomed holder 28 is slidably mounted on the guide rails 26 for sliding movement along the Z-axis and disposed in front of the guide rails 26. A nut 30 is fixedly mounted on a rear surface of the holder 28. The nut 30 is operatively threaded over a screw shaft 32 rotatably disposed between the guide rails 26 and extending along the Z-axis. The screw shaft 32 has an upper end connected to a rotary actuator 34 such as an electric motor for rotating the screw shaft 32 about its central axis. When the rotary actuator 34 is energized, it rotates the screw shaft 32 about its central axis, causing the nut 30 to move the holder 28 along the Z-axis.

The holder 28 holds a grinding unit 36 having a hollow cylindrical spindle housing 38 disposed in the holder 28. The spindle housing 38 is supported on a bottom wall of the holder 28. The grinding unit 36 includes a cylindrical spindle 40 having a portion rotatably housed in the spindle housing 38. The spindle 40 has a longitudinal axis extending vertically along the Z-axis. The spindle 40 has an upper end. An unillustrated rotary actuator such as an electric motor is provided near the upper end portion of the spindle 40.

The spindle 40 has a lower end portion protruding downwardly from the holder 28 through a through opening defined in the bottom wall of the holder 28. A circular plate mount 42 is mounted on a lower end of the spindle 40. An annular grinding wheel 44 is mounted on the lower end of the spindle 40 through the mount 42. The grinding wheel 44 has an outside diameter substantially equal to the diameter of the mount 42. The grinding wheel 44 includes an annular base 46 made of a metal material such as aluminum alloy. The annular base 46 has an upper surface secured to a lower surface of the mount 42 by unillustrated fasteners such as screws. The annular base 46 has a lower surface 46*a* on which there is disposed an annular array of grindstones 48 spaced at substantially equal intervals along circumferential directions of the annular base 46. Each of the grindstones 48 is shaped substantially like a block and is made up of abrasive grains of diamond or cubic boron nitride (cBN) and a binder, i.e., a binding material, of metal, resin, or ceramic holding the abrasive grains together.

Figure 3A:
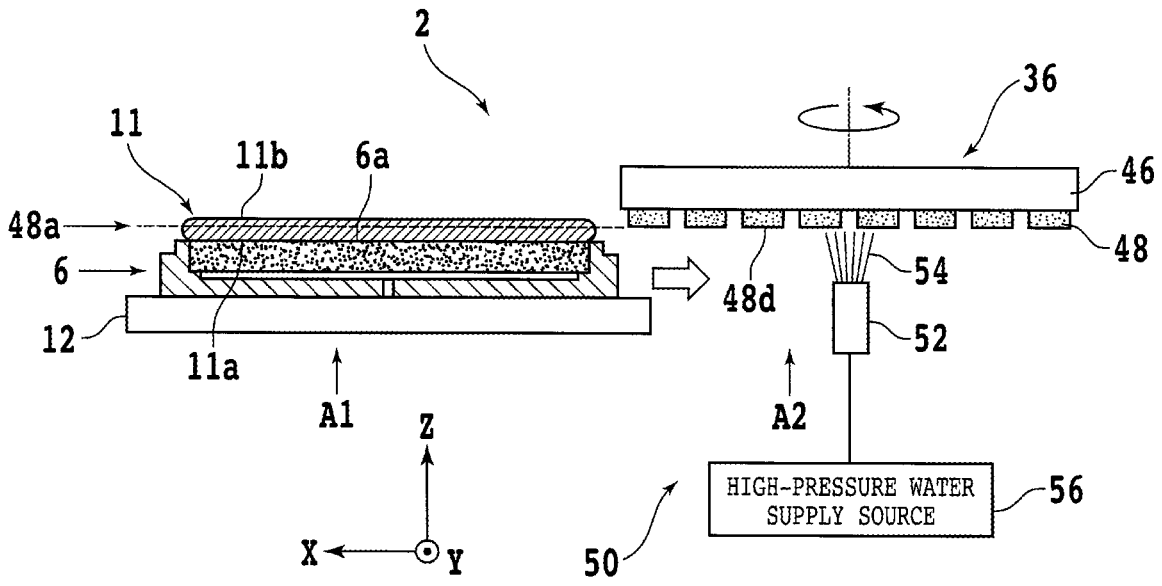
FIG. 3A is a side elevational view, partly in cross section, of a workpiece and components of the creep feed grinding apparatus at the time the creep feed grinding mode is started.

When the Z-axis moving mechanism 24 is operated, it moves the grinding unit 36 along the Z-axis relative to the chuck table 6, i.e., toward or away from the chuck table 6. The grinding unit 36 including the grinding wheel 44, i.e., the grindstones 48, is thus adjusted in vertical position or height with respect to the chuck table 6. When the spindle 40 is rotated about its central axis by the rotary actuator connected thereto, the grindstones 48 provide an annular grinding surface 48*a* (see FIG. 3A) along an annular track followed by bottom surfaces 48*d* of the grindstones 48 as they rotate in unison with the grinding wheel 44. In FIG. 3A, the annular grinding surface 48*a* is illustrated in its vertical position along the Z-axis.

Figure 2:
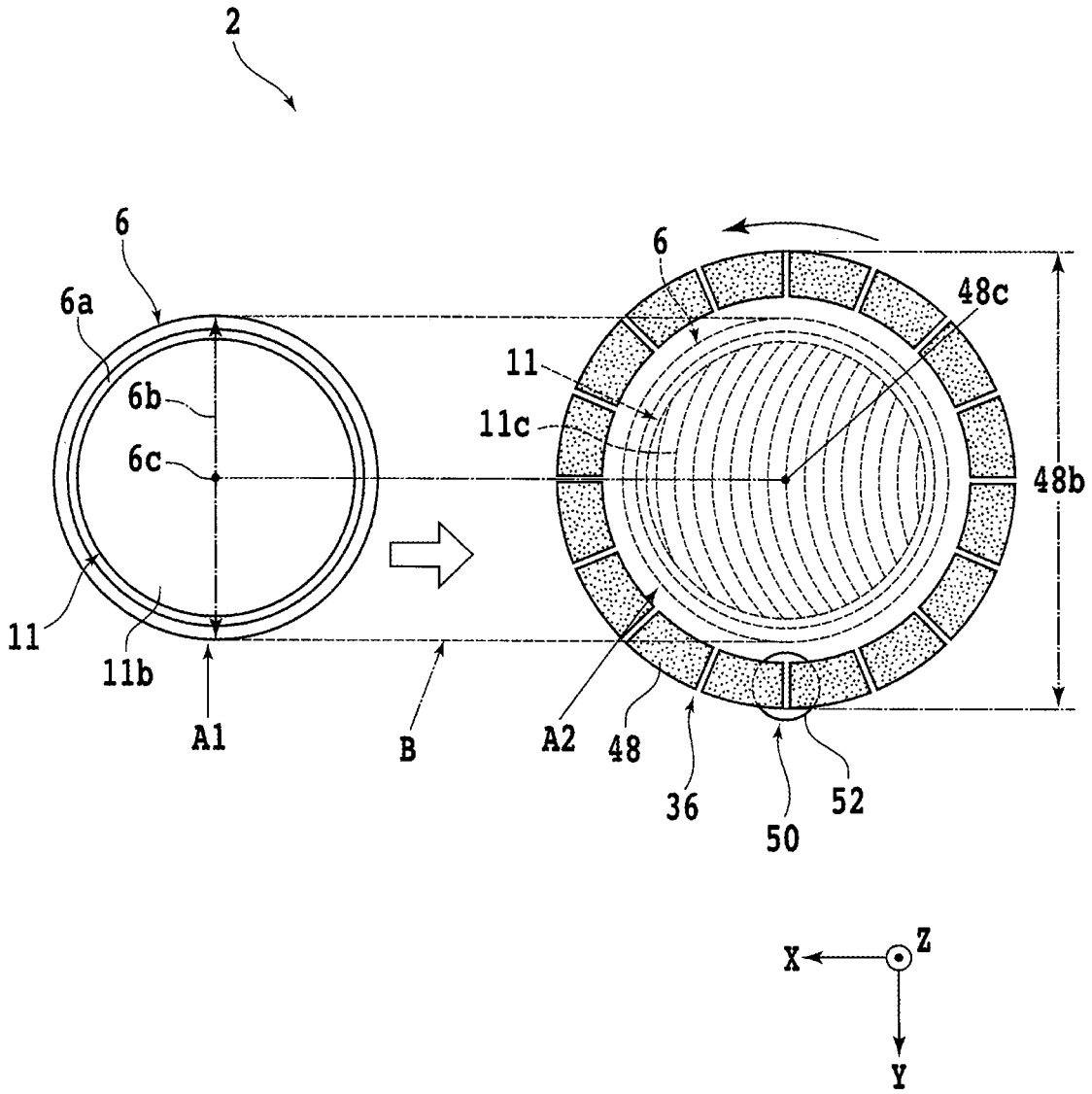
FIG. 2 is a plan view illustrating the manner in which the creep feed grinding apparatus operates in a creep feed grinding mode.

FIG. 2 illustrates in plan the manner in which the creep feed grinding apparatus 2 operates in a creep feed grinding mode. The annular track followed by the bottom surfaces 48*d* of the grindstones 48 at the time the spindle 40 is rotated about its central axis, i.e., the annular grinding surface 48*a*, has an outside diameter 48*b* that is larger than a diameter 6*b* of the chuck table 6. For example, the outside diameter 48*b* is 500 mm and the diameter 6*b* is 300 mm. The outside diameter 48*b* may be larger than the diameter 6*b* by 60 mm or more. As viewed in plan on an X-Y plane, the outside diameter 48*b* of the grinding surface 48*a* has a center 48*c* and the diameter 6*b* of the chuck table 6 has a center 6*c*, the centers 48*c* and 6*c* being positioned on a straight line along the X-axis. When the chuck table 6 is relatively moved along in one of the X-axis directions to a position directly below the grinding wheel 44, i.e., the grinding unit 36, and is vertically aligned with the grinding wheel 44, the chuck table 6 is positioned radially inwardly of an inner circumferential edge of the grinding wheel 44 as viewed in plan as indicated by the broken lines in FIG. 2.

The creep feed grinding apparatus 2 according to the first embodiment includes a bottom surface state adjusting unit 50. The bottom surface state adjusting unit 50 has a first nozzle, i.e., a bottom surface state adjusting mechanism, 52 disposed outside of a relative movement area B (see FIG. 2) in which the chuck table 6 is movable relative to the grinding unit 36 along the Y-axis. The first nozzle 52 is kept in a fixed position relative to the grinding unit 36. For example, the first nozzle 52 is fixed to the base 4 at a position directly below the grinding surface 48*a*. The distance between the first nozzle 52 and the grinding surface 48*a* positioned directly above the first nozzle 52 during a grinding process is adjusted in advance depending on the speed of high-pressure water 54 ejected from the first nozzle 52.

As illustrated in FIG. 3A, the first nozzle 52 is fluidly connected to a high-pressure water supply source 56. The high-pressure water supply source 56 has an unillustrated tank containing pure water therein and an unillustrated pump for increasing the pressure of the pure water supplied from the tank to a predetermined pressure. During the creep feed grinding mode, the first nozzle 52 ejects the high-pressure water 54 that has been pressurized to 0.1 MPa or higher, e.g., a predetermined pressure value ranging from 2 MPa to 13 MPa, upwardly to the grindstones 48, thereby adjusting the bottom surfaces 48*d* (see FIG. 3A) of the grindstones 48.

When the creep feed grinding apparatus 2 is to perform creep feed grinding on the workpiece 11, the chuck table 6 holds a face side 11*a* of the workpiece 11 under suction thereon such that a reverse side 11*b* thereof is exposed upwardly. Providing devices are formed on the face side 11*a*, a protective tape of resin is affixed to the face side 11*a* to protect the devices, and then the chuck table 6 holds the face side 11*a* under suction thereon. The chuck table 6 holds the face side 11*a* under suction thereon in a loading/unloading area A1 positioned on a front side of the creep feed grinding apparatus 2. After the chuck table 6 has held the face side 11*a* under suction thereon, the spindle 40 is rotated about its central axis at a predetermined rotational speed, and the Z-axis moving mechanism 24 adjusts the height or vertical position of the grinding surface 48*a* to a position between the holding surface 6*a* and the reverse side 11*b* of the workpiece 11 (see FIG. 3A) such that the bottom surfaces 48*d* of the grindstones 48 come into contact with the reverse side 11*b*. The rotational speed of the spindle 40 may be set to an appropriate value depending on the outside diameter 48*b* of the grinding surface 48*a*. For example, if the outside diameter 48*b* is 500 mm, then the rotational speed of the spindle 40 is set to 2000 rpm, and if the outside diameter 48*b* is 300 mm, then the rotational speed of the spindle 40 is set to 3200 rpm.

After the Z-axis moving mechanism 24 has adjusted the height or vertical position of the grinding surface 48*a*, the first nozzle 52 starts ejecting the high-pressure water 54 upwardly, and the chuck table 6 starts moving toward the grinding unit 36 in a processing feed direction indicated by the arrow in FIGS. 2 and 3A, whereupon the creep feed grinding apparatus 2 starts grinding the workpiece 11 in the creep feed grinding mode, or more specifically, the grindstones 48 start grinding the reverse side 11*b* as they move along the annular track in contact therewith. FIG. 3A illustrates in side elevation, partly in cross section, the workpiece 11 and components of the creep feed grinding apparatus 2 at the time the creep feed grinding mode is started. In the creep feed grinding mode, the X-axis moving mechanism 20 moves the chuck table 6 to a predetermined area A2 on a rear side of the creep feed grinding apparatus 2 at a predetermined speed of 10 mm/s., for example.

Figure 3B:
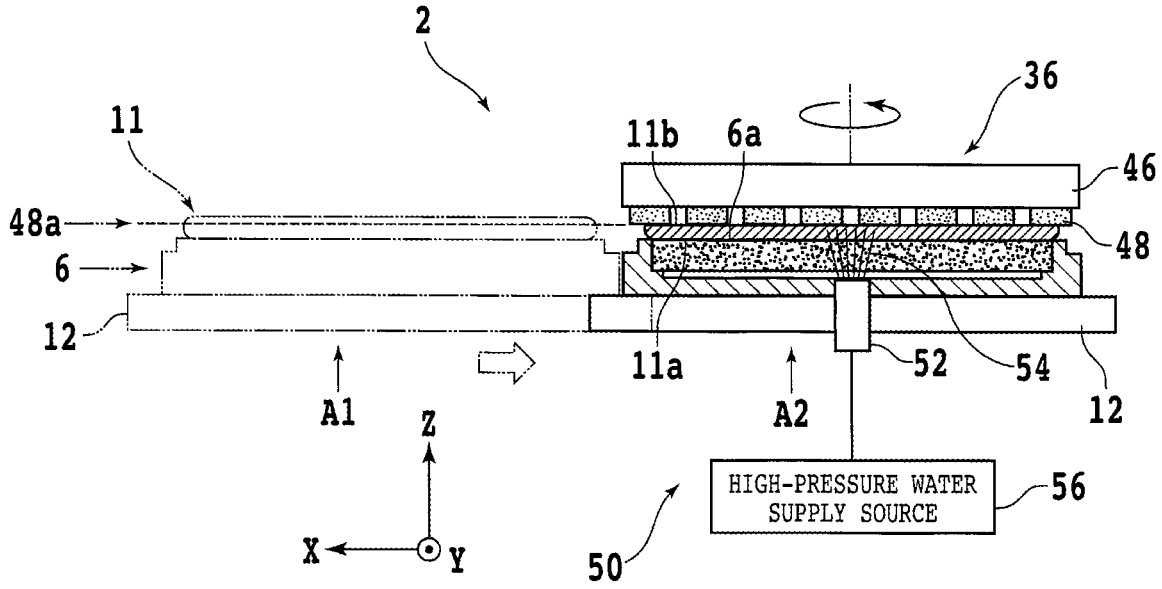
FIG. 3B is a side elevational view, partly in cross section, of the workpiece and the components of the creep feed grinding apparatus obtained after a single pass of a chuck table in the creep feed grinding mode.

According to the first embodiment, the predetermined area A2 is positioned directly below the grinding unit 36. The chuck table 6 that has been moved to the predetermined area A2 is positioned radially inwardly of the inner circumferential edge of the grinding surface 48*a* as viewed in plan on the X-Y plane (see FIG. 2). As the grindstones 48 move to the predetermined area A2, their side surfaces and the bottom surfaces 48*d* grind the reverse side 11*b* of the workpiece 11, leaving a plurality of arcuate saw marks 11*c* (see FIG. 2) on the reverse side 11*b* that are successively arranged along the processing feed direction. FIG. 3B illustrates in side elevation, partly in cross section, the workpiece 11 and components of the creep feed grinding apparatus 2 obtained after a single pass of the chuck table 6 in the creep feed grinding mode.

Figure 4:
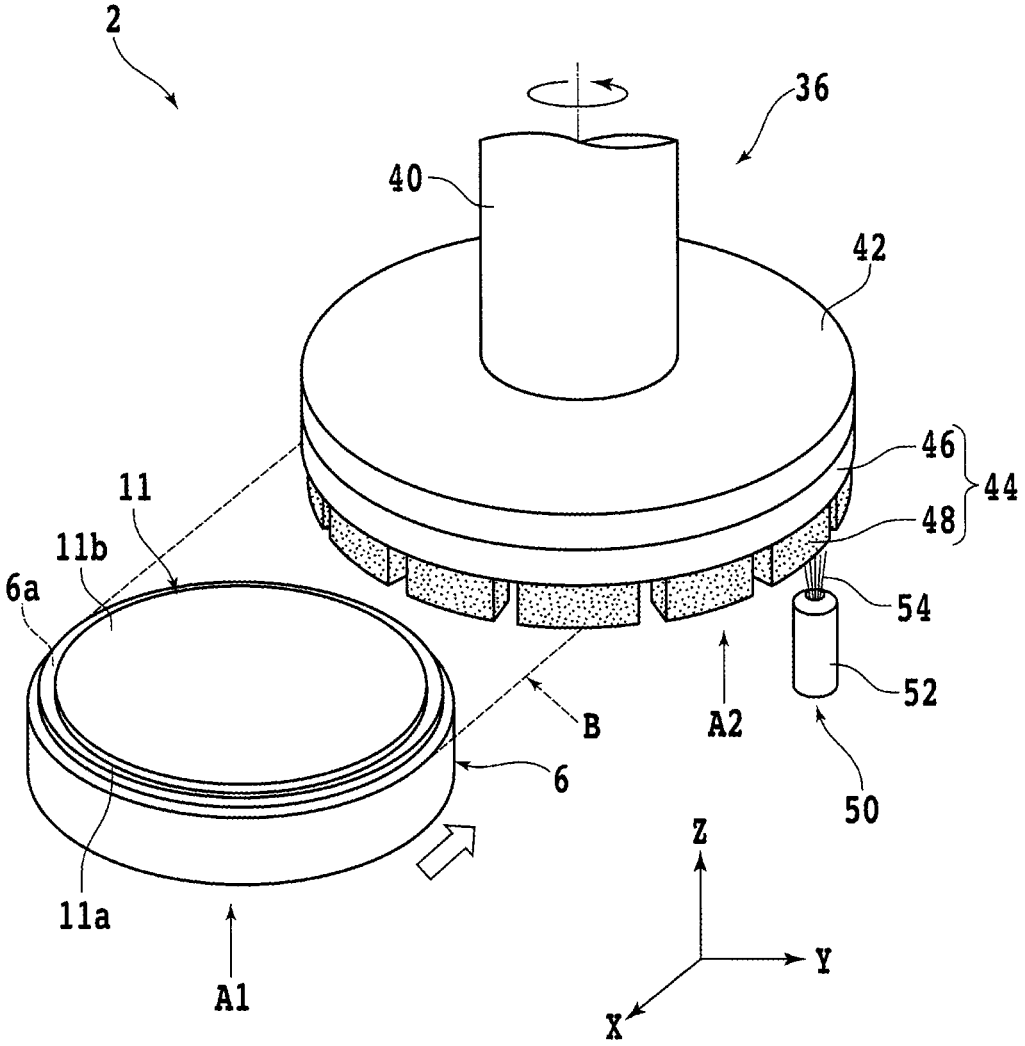
FIG. 4 is a perspective view of the workpiece and the components of the creep feed grinding apparatus that is operating in the creep feed grinding mode.

A single pass refers to a single operation in which the chuck table 6 and the grinding unit 36 are to be moved relative to each other in a predetermined direction in order to move the chuck table 6 from a position outside of the grinding wheel 44 in the X-Y plane until it is positioned directly below the grinding wheel 44. According to the first embodiment, a single progression of the chuck table 6 from outside of the grinding wheel 44 to the position directly below the grinding wheel 44 in a direction along the X-axis from the loading/unloading area A1 (see FIG. 3A) to the predetermined area A2 (see FIG. 3B) is referred to as a single pass. According to the first embodiment, when the workpiece 11 is ground by the grinding wheel 44 in the single pass in the creep feed grinding mode, the first nozzle 52 ejects the high-pressure water 54 to the bottom surfaces 48*d* of the grindstones 48, thereby cleaning and/or correcting, i.e., cleaning and correcting or cleaning or correcting, the bottom surfaces 48*d* with the high-pressure water 54. FIG. 4 illustrates in perspective the workpiece 11 and the components of the creep feed grinding apparatus 2 that is operating in the creep feed grinding mode.

According to the first embodiment, since the high-pressure water 54 is ejected to the bottom surfaces 48*d* of the grindstones 48, it is possible to at least remove grinding debris or swarf from the grindstones 48, dress the grindstones 48, or correct the shape of the grindstones 48 at the bottom surfaces 48*d* thereof, thereby eliminating a grindstone condition failure of the bottom surfaces 48*d* in the creep feed grinding mode. Consequently, a grindstone condition failure of the bottom surfaces 48*d* can be eliminated without a reduction in the efficiency of grinding in the creep feed grinding mode. Furthermore, inasmuch as the first nozzle 52 is positioned outside of the relative movement area B (see FIG. 2) in which the chuck table 6 is movable relative to the grinding unit 36, the space outside of the relative movement area B is effectively utilized.

For grinding and thinning down the workpiece 11 to a desired finished thickness, the creep feed grinding apparatus 2 may perform the creep feed grinding mode by moving the chuck table 6 in two or more passes. Specifically, when the creep feed grinding apparatus 2 is to perform the creep feed grinding mode by moving the chuck table 6 in a second pass, the grinding unit 36 is lifted to a height where the grindstones 48 will not contact the workpiece 11 after the chuck table 6 has been moved to the position directly below the grinding unit 36 in the first pass. Then, the chuck table 6 is moved from the predetermined area A2 back to the loading/unloading area A1 where the chuck table 6 does not underlie the grinding wheel 44 as viewed in plan on the X-Y plane. Thereafter, the grinding unit 36 is lowered to a position for contact with the workpiece 11, and then the chuck table 6 is moved along the X-axis from the loading/unloading area A1 (see FIG. 3A) to the predetermined area A2 (see FIG. 3B) to grind the workpiece 11 in the second pass in the creep feed grinding mode. The grinding wheel 44 and the chuck table 6 may be moved in the same fashion for a third pass or third and subsequent passes until the workpiece 11 is thinned down to a desired finished thickness. While the creep feed grinding apparatus 2 is performing the creep feed grinding mode, the first nozzle 52 continuously ejects the high-pressure water 54. However, the first nozzle 52 stops ejecting the high-pressure water 54 during the movement of the chuck table 6 from the predetermined area A2 back to the loading/unloading area A1.

Two or more first nozzles 52 may be disposed directly below the grinding surface 48*a* unless they are in interference with the relative movement area B. For example, two or more first nozzles 52 may be disposed outside of the relative movement area B on one side or respective both sides thereof along the Y-axis. In particular, if two first nozzles 52 are disposed diametrically across the center 48*c* on the outside diameter 48*b* of the grinding surface 48*a*, then regardless of the direction in which the spindle 40 is rotated, the bottom surfaces 48*d* of the grindstones 48 can be cleaned and/or corrected by the high-pressure water 54 immediately before or after the bottom surfaces 48*d* contact the workpiece 11. Accordingly, the degree of freedom of the spindle 40 can be secured.

Figure 5:
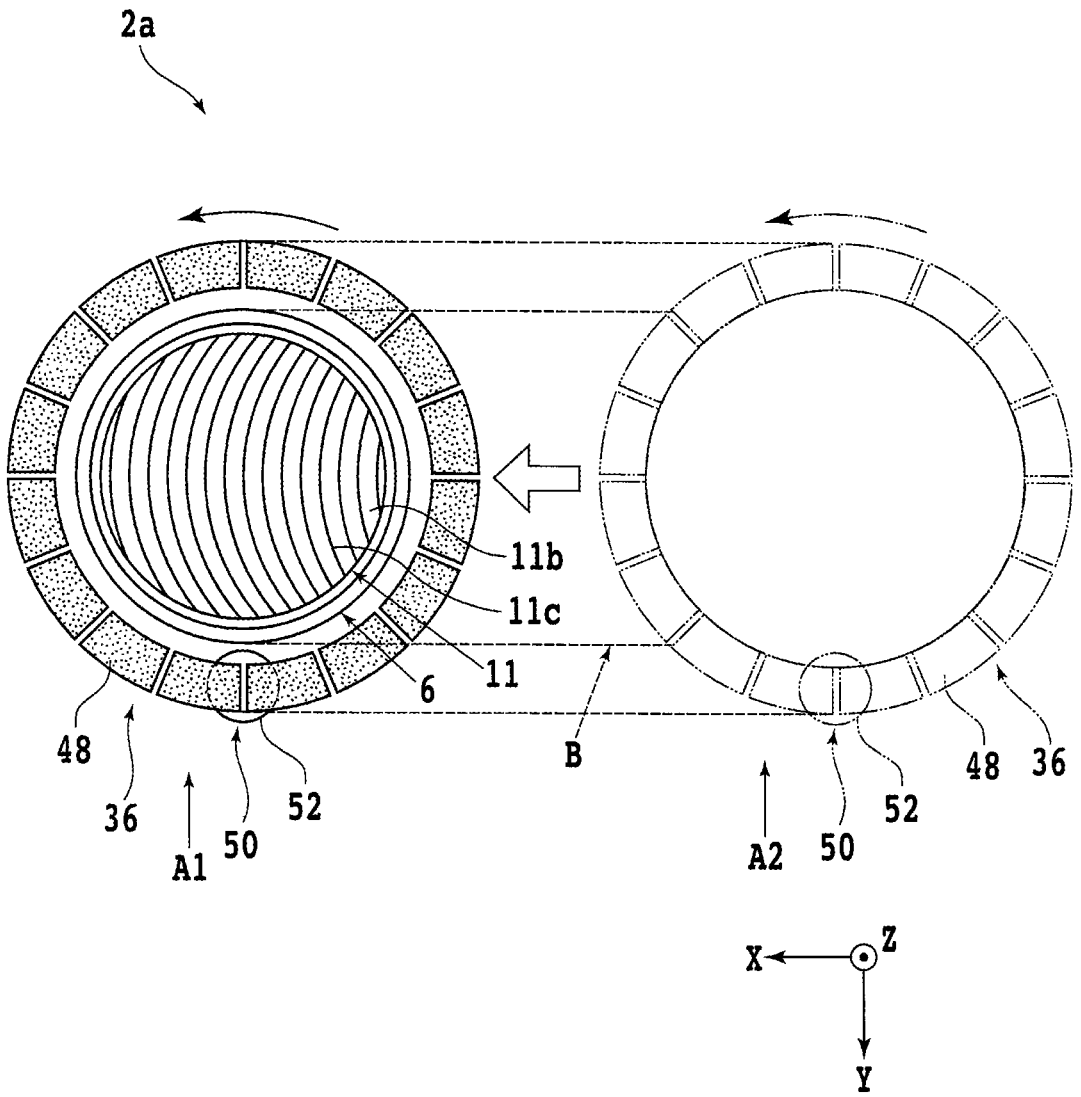
FIG. 5 is a plan view of a creep feed grinding apparatus according to a first modification of the first embodiment.
Figure 6:
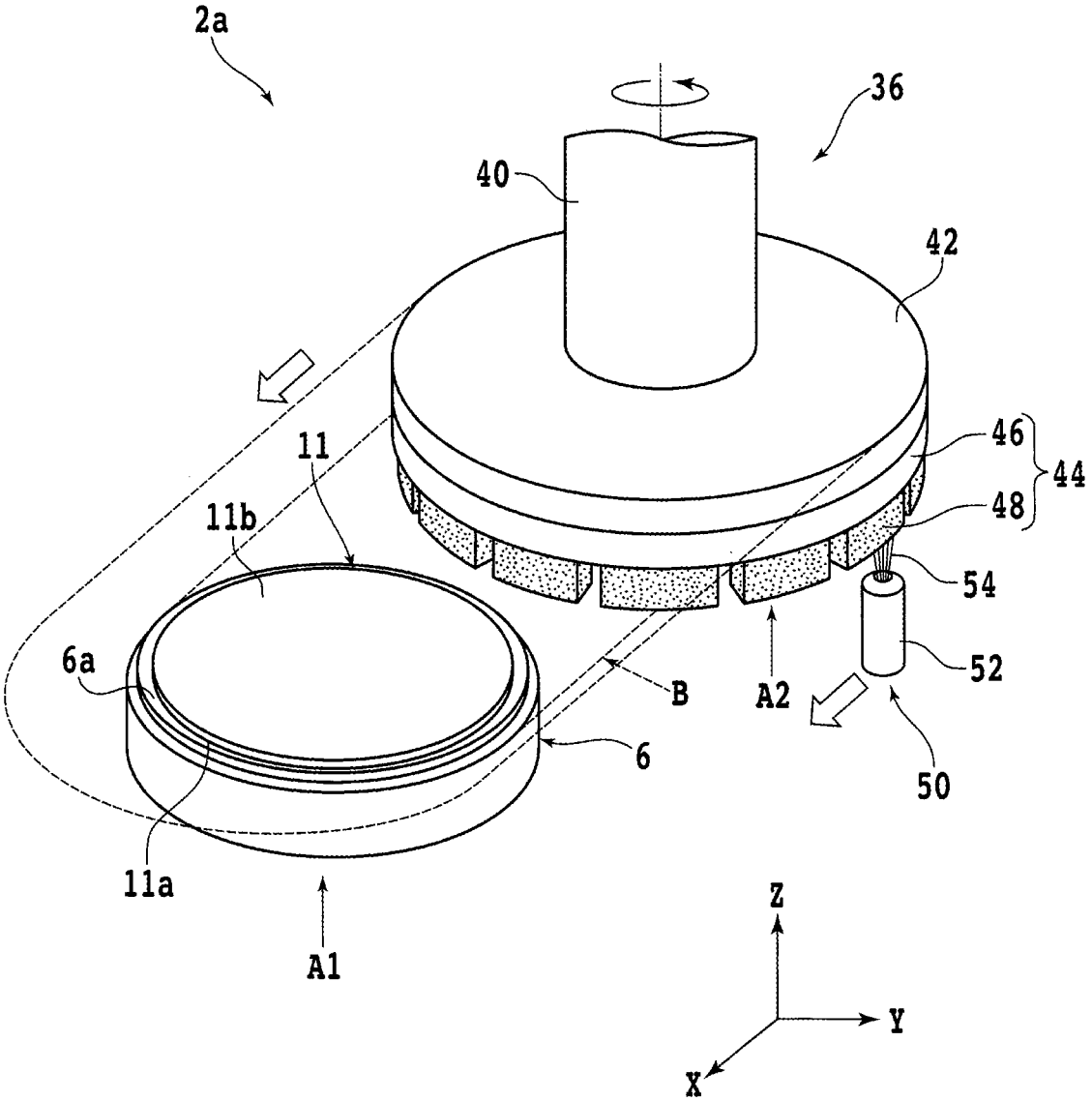
FIG. 6 is a perspective view of the creep feed grinding apparatus according to the first modification of the first embodiment.

A first modification of the first embodiment will be described below with reference to FIGS. 5 and 6. FIG. 5 illustrates in plan a creep feed grinding apparatus 2*a* according to the first modification, and FIG. 6 illustrates in perspective the creep feed grinding apparatus 2*a* according to the first modification. According to the first modification, the chuck table 6 is not moved by the X-axis moving mechanism 20 and remains stationary at all times. On the other hand, the support structure 22 to which the Z-axis moving mechanism 24 is fixed is movable along the X-axis by a moving mechanism similar to the X-axis moving mechanism 20. The moving mechanism has an unillustrated X-axis movable plate that supports the support structure 22 thereon.

The first nozzle 52 is fixedly mounted on the holder 28 or the X-axis movable plate, so that the first nozzle 52 is movable with the support structure 22 along the X-axis. Other details of the creep feed grinding apparatus 2*a* according to the first modification are identical to those of the creep feed grinding apparatus 2 according to the first embodiment. According to the first modification, it is also possible to at least remove grinding debris or swarf from the grindstones 48, dress the grindstones 48, or correct the shape of the grindstones 48 at the bottom surfaces 48*d* thereof in the creep feed grinding mode. Consequently, a grindstone condition failure of the bottom surfaces 48*d* can be eliminated without a reduction in the efficiency of grinding in the creep feed grinding mode.

Figure 7:
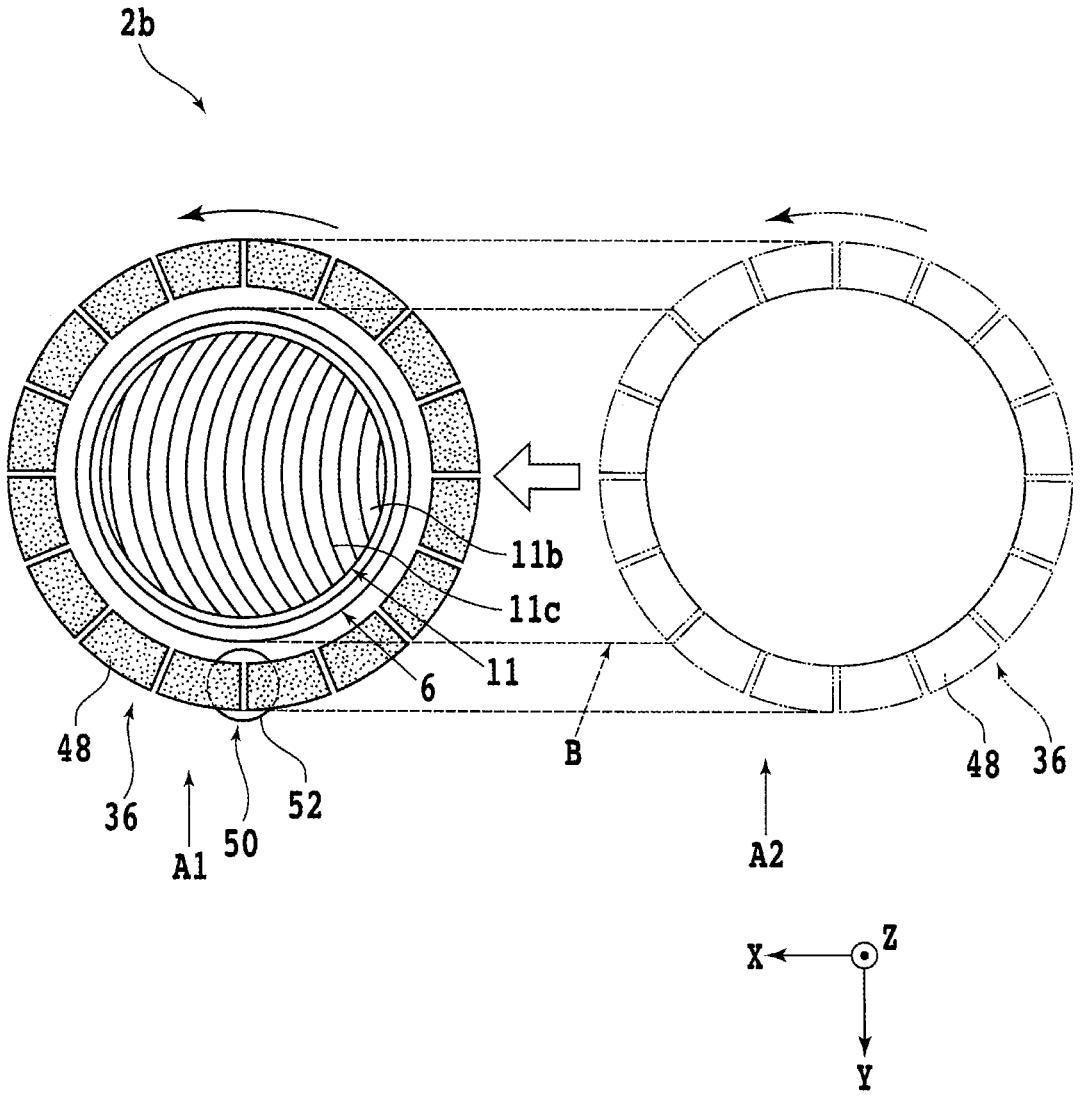
FIG. 7 is a plan view of a creep feed grinding apparatus according to a second modification of the first embodiment.

A second modification of the first embodiment will be described below with reference to FIG. 7. FIG. 7 illustrates in plan a creep feed grinding apparatus 2*b* according to the second modification. According to the second modification, the chuck table 6 also remains stationary at all times, and the support structure 22 to which the Z-axis moving mechanism 24 is fixed is also movable along the X-axis. According to the second modification, however, the first nozzle 52 is fixed in position in the vicinity of the chuck table 6 and is not movable along the X-axis.

The second modification is different from the first modification in that the first nozzle 52 is disposed on a straight line parallel to the Y-axis across the center 6*c* (see FIG. 2) as viewed in plan on the X-Y plane, directly below a relative movement area in which the grinding surface 48*a* is movable relative to the chuck table 6 outside of the relative movement area B. Other details of the creep feed grinding apparatus 2*b* according to the second modification are identical to those of the creep feed grinding apparatus 2*a* according to the first modification. According to the second modification, it is also possible to at least remove grinding debris or swarf from the grindstones 48, dress the grindstones 48, or correct the shape of the grindstones 48 at the bottom surfaces 48*d* thereof in the creep feed grinding mode.

Figure 8:
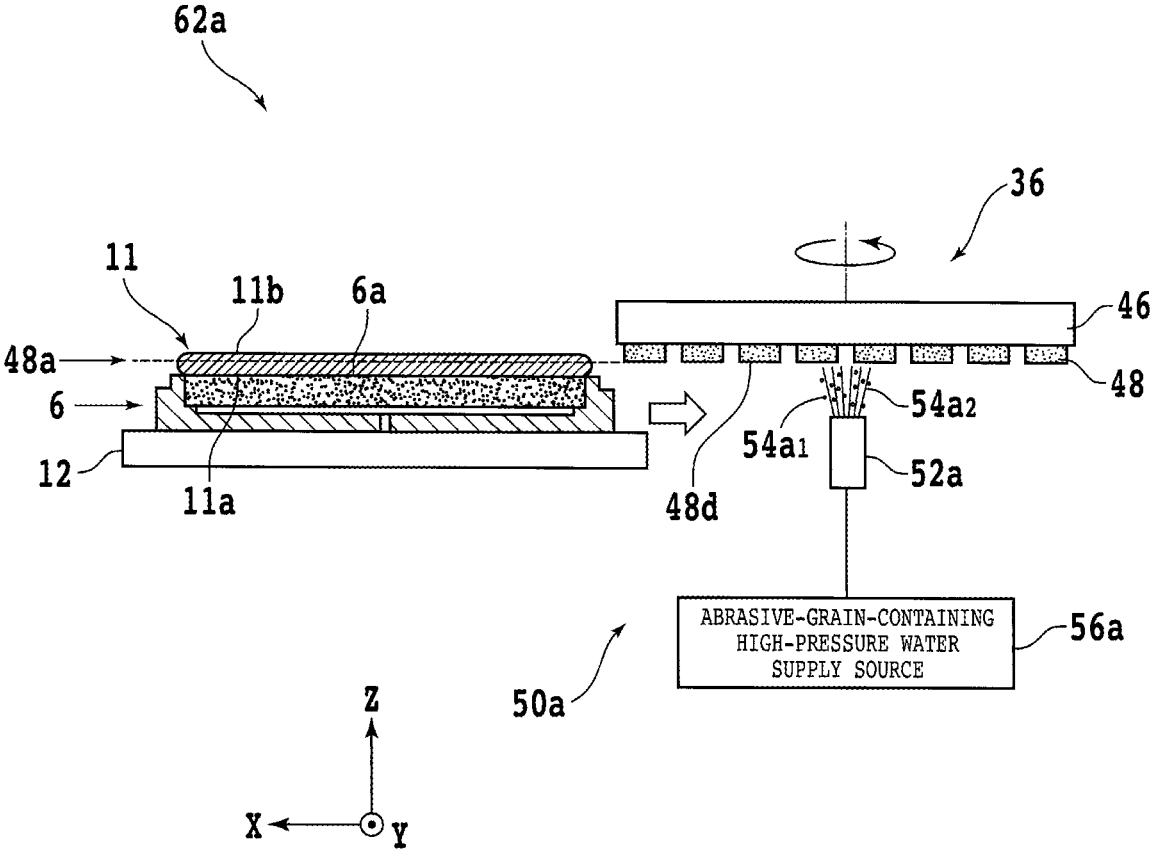
FIG. 8 is a side elevational view, partly in cross section, of a creep feed grinding apparatus according to a second embodiment of the present invention.

A second embodiment of the present invention will be described below. FIG. 8 illustrates in side elevation, partly in cross section, a creep feed grinding apparatus 62*a* according to the second embodiment. The creep feed grinding apparatus 62*a* includes a bottom surface state adjusting unit 50*a*. The bottom surface state adjusting unit 50*a* has a second nozzle, i.e., a bottom surface state adjusting mechanism, 52*a* whose relative position with respect to the grinding unit 36 is fixed. The second nozzle 52*a* illustrated in FIG. 8 is fixed to the base 4 and disposed at a position directly below the grinding surface 48*a* outside of the relative movement area B (see FIG. 2) in which the chuck table 6 is movable relative to the grinding unit 36.

The second nozzle 52*a* ejects high-pressure water 54$a_2$ that includes abrasive grains 54$a_1$ and that is pressurized to 0.1 MPa or higher, e.g., a predetermined pressure value ranging from 2 MPa to 13 MPa, upwardly to the grindstones 48. The abrasive grains 54$a_1$ have an average particle size smaller than the average particle size of the abrasive grains of the grindstones 48. The second nozzle 52*a* is fluidly connected to an abrasive-grain-containing high-pressure water supply source 56*a*. The abrasive-grain-containing high-pressure water supply source 56*a* has an unillustrated tank containing pure water mixed with abrasive grains 54$a_1$ and an unillustrated pump for increasing the pressure of the pure water mixed with the abrasive grains 54$a_1$ supplied from the tank to a predetermined pressure.

According to the second embodiment, when the workpiece 11 is ground by the grinding wheel 44 in the creep feed grinding mode, the second nozzle 52*a* ejects the high-pressure water 54 containing the abrasive grains 54$a_1$ to the bottom surfaces 48*d* of the grindstones 48, thereby cleaning and/or correcting, i.e., cleaning and correcting or cleaning or correcting, the bottom surfaces 48*d* with the high-pressure water 54 containing the abrasive grains 54$a_1$. Thus, it is possible to at least remove grinding debris or swarf from the grindstones 48, dress the grindstones 48, or correct the shape of the grindstones 48 at the bottom surfaces 48*d* thereof. Consequently, a grindstone condition failure of the bottom surfaces 48*d* can be eliminated without a reduction in the efficiency of grinding in the creep feed grinding mode.

In FIG. 8, the single second nozzle 52*a* is disposed directly below the grinding surface 48*a*. However, two or more second nozzles 52*a* may be disposed directly below the grinding surface 48*a* unless they are in interference with the relative movement area B. For example, two or more second nozzles 52*a* may be disposed outside of the relative movement area B on one side or respective both sides thereof along the Y-axis. In particular, if two second nozzles 52*a* are disposed diametrically across the center 48*c* on the outside diameter 48*b* of the grinding surface 48*a*, then as described above, the degree of freedom of the spindle 40 can be secured. The first modification or the second modification described above is also applicable to the creep feed grinding apparatus 62*a* according to the second embodiment.

Figure 9:
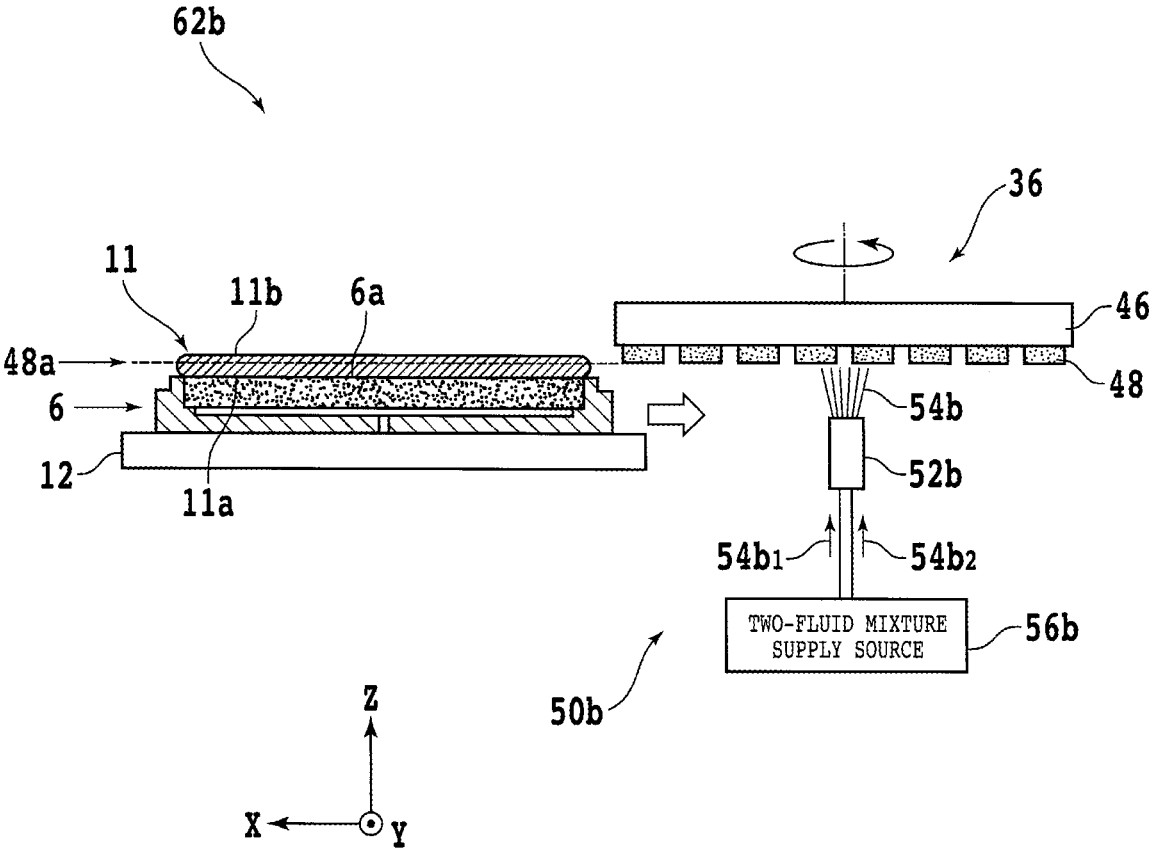
FIG. 9 is a side elevational view, partly in cross section, of a creep feed grinding apparatus according to a third embodiment of the present invention.

A third embodiment of the present invention will be described below. FIG. 9 illustrates in side elevation, partly in cross section, a creep feed grinding apparatus 62*b* according to the third embodiment. The creep feed grinding apparatus 62*b* includes a bottom surface state adjusting unit 50*b*. The bottom surface state adjusting unit 50*b* has a third nozzle, i.e., a bottom surface state adjusting mechanism, 52*b* whose relative position with respect to the grinding unit 36 is fixed. The third nozzle 52*b* illustrated in FIG. 9 is fixed to the base 4 and disposed at a position directly below the grinding surface 48*a* outside of the relative movement area B (see FIG. 2) in which the chuck table 6 is movable relative to the grinding unit 36.

The third nozzle 52*b* ejects a two-fluid mixture 54*b* of pure water 54*b*1 and air 54*b*2 upwardly. For example, pure water 54$b_1$ that has been pressurized to 0.8 MPa and air 54*b*2 that has been pressurized to 0.3 MPa are independently supplied to the third nozzle 52*b* in which they are mixed together, and they are injected as the two-fluid mixture 54*b* upwardly from the third nozzle 52*b*.

The third nozzle 52*b* is fluidly connected to a two-fluid mixture supply source 56*b* through a conduit for pure water 54*b*1 and a conduit for air 54$b_2$. The two-fluid mixture supply source 56*b* includes an unillustrated pure water supply source having an unillustrated pump for supplying pressurized pure water 54*b*1 and an unillustrated tank containing pure water 54*b*1 therein. The two-fluid mixture supply source 56*b* also includes an unillustrated air supply source having an unillustrated pump for supplying pressurized air 54$b_2$ and an unillustrated tank containing air 54$b_2$ therein.

According to the third embodiment, when the workpiece 11 is ground by the grinding wheel 44 in the creep feed grinding mode, the third nozzle 52*b* ejects the two-fluid mixture 54*b* to the bottom surfaces 48*d* of the grindstones 48, thereby cleaning and/or correcting the bottom surfaces 48*d* with the two-fluid mixture 54*b*. Thus, it is possible to at least remove grinding debris or swarf from the grindstones 48, dress the grindstones 48, or correct the shape of the grindstones 48 at the bottom surfaces 48*d* thereof. Consequently, a grindstone condition failure of the bottom surfaces 48*d* can be eliminated without a reduction in the efficiency of grinding in the creep feed grinding mode.

In FIG. 9, the single third nozzle 52*b* is disposed directly below the grinding surface 48*a* outside of the relative movement area B. However, two or more third nozzles 52*b* may be disposed directly below the grinding surface 48*a*. For example, two or more third nozzles 52*b* may be disposed outside of the relative movement area B on one side or respective both sides thereof along the Y-axis. In particular, if two third nozzles 52*b* are disposed diametrically across the center 48*c* on the outside diameter 48*b* of the grinding surface 48*a*, then as described above, the degree of freedom of the spindle 40 can be secured. The first modification or the second modification described above is also applicable to the creep feed grinding apparatus 62*b* according to the third embodiment.

Figure 10:
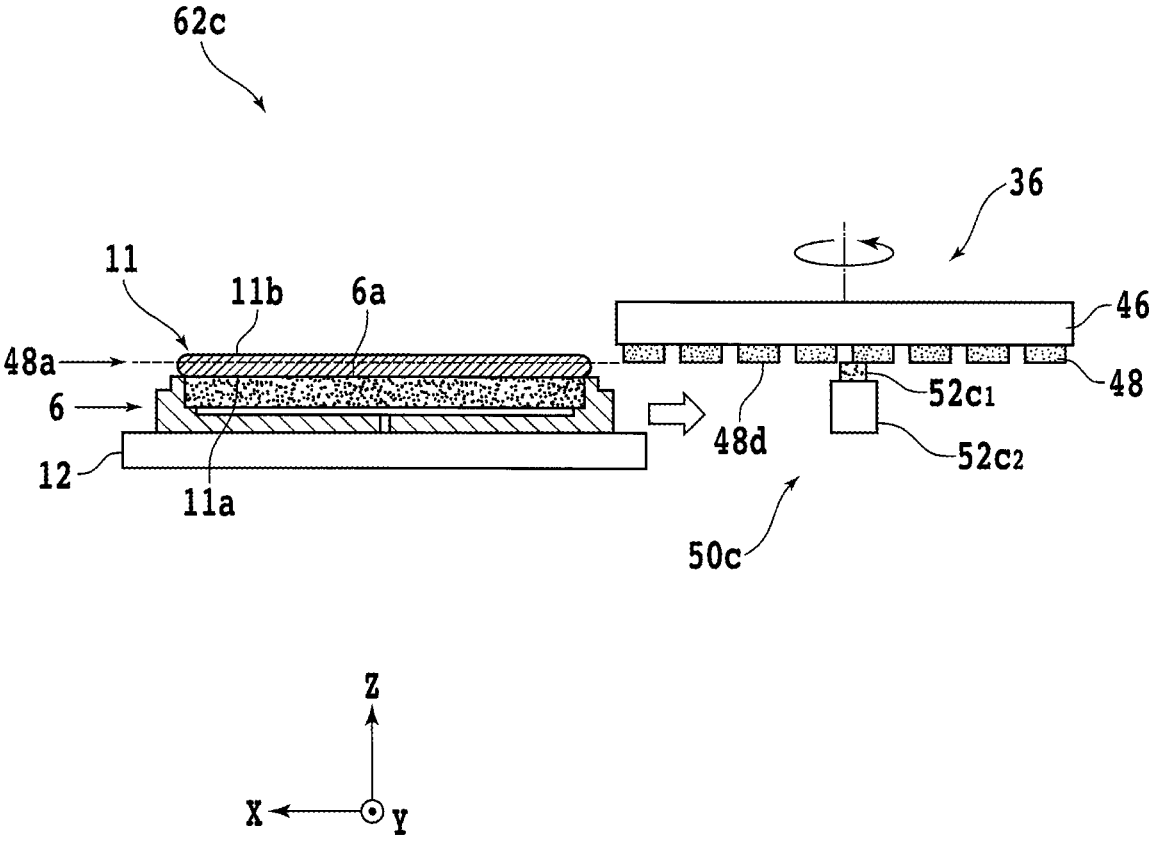
FIG. 10 is a side elevational view, partly in cross section, of a creep feed grinding apparatus according to a fourth embodiment of the present invention.

A fourth embodiment of the present invention will be described below. FIG. 10 illustrates in side elevation, partly in cross section, a creep feed grinding apparatus 62*c* according to the fourth embodiment. The creep feed grinding apparatus 62*c* includes a bottom surface state adjusting unit 50*c*. The bottom surface state adjusting unit 50*c* has a circular plate dresser, i.e., a bottom surface state adjusting mechanism, $\mathbf{52}c_1$ whose relative position with respect to the grinding unit 36 is fixed. The dresser $\mathbf{52}c_1$ is supported on and fixed to a cylindrical base $\mathbf{52}c_2$. The base $\mathbf{52}c_2$ is mounted on the base 4 by an unillustrated lifting and lowering mechanism for selectively lifting and lowering the base $\mathbf{52}c_2$ along the Z-axis. The dresser $\mathbf{52}c_1$ is disposed at a position directly below the grinding surface 48*a* outside of the relative movement area B (see FIG. 2).

The dresser $\mathbf{52}c_1$ has a diameter ranging from 1 cm to 5 cm and a thickness ranging from 1 mm to 5 mm, for example. The dresser $\mathbf{52}c_1$ may be referred to as a dressing board. The diameter of the dresser $\mathbf{52}c_1$ is selected depending on the width of each of the grindstones 48. The dresser $\mathbf{52}c_1$ is made up of a binder such as a vitrified bond and abrasive grains of white alundum (WA), green carbon (GC), or the like that are bound together by the binder.

When the creep feed grinding apparatus 62*c* starts to operate in the creep feed grinding mode, the lifting and lowering mechanism lifts the dresser $\mathbf{52}c_1$ to a lifted position in which the height or vertical position of an upper surface thereof is aligned with the height or vertical position of the grinding surface 48*a*. When the creep feed grinding apparatus 62*c* is not grinding the workpiece 11, e.g., when the creep feed grinding apparatus 62*c* is serviced for maintenance, the lifting and lowering mechanism lowers the dresser $\mathbf{52}c_1$ to a predetermined lowered position out of contact with the bottom surfaces 48*d*. The lifting and lowering mechanism may have an actuating unit such as an air cylinder for positioning the dresser $\mathbf{52}c_1$ selectively in the lifted position and the lowered position and a ball-screw-type moving mechanism for finely adjusting the height of the base $\mathbf{52}c_2$ depending on the extent to which the dresser $\mathbf{52}c_1$ is worn.

According to the fourth embodiment, when the workpiece 11 is ground by the grinding wheel 44 in the creep feed grinding mode, the dresser $\mathbf{52}c_1$ is held in contact with the bottom surfaces 48*d* of the grindstones 48, thereby cleaning and/or correcting the bottom surfaces 48*d*. Thus, it is possible to at least remove grinding debris or swarf from the grindstones 48, dress the grindstones 48, or correct the shape of the grindstones 48 at the bottom surfaces 48*d* thereof. Consequently, a grindstone condition failure of the bottom surfaces 48*d* can be eliminated without a reduction in the efficiency of grinding in the creep feed grinding mode. In FIG. 10, the single dresser $\mathbf{52}c_1$ is disposed directly below the grinding surface 48*a* outside of the relative movement area B. However, two or more dressers $\mathbf{52}c_1$ may be disposed directly below the grinding surface 48*a*.

Furthermore, two or more dressers $\mathbf{52}c_1$ may be disposed outside of the relative movement area B on one side or respective both sides thereof along the Y-axis. Since the load on each of the two or more dressers $\mathbf{52}c_1$ is smaller than the load on the single dresser $\mathbf{52}c_1$ when the grindstones 48 are dressed, the two or more dressers $\mathbf{52}c_1$ may be replaced less frequently. In particular, if two dressers $\mathbf{52}c_1$ are disposed diametrically across the center 48*c* on the outside diameter 48*b* of the grinding surface 48*a*, then as described above, the degree of freedom of the spindle 40 can be secured. The first modification or the second modification described above is also applicable to the creep feed grinding apparatus 62*c* according to the fourth embodiment.

Figure 11:
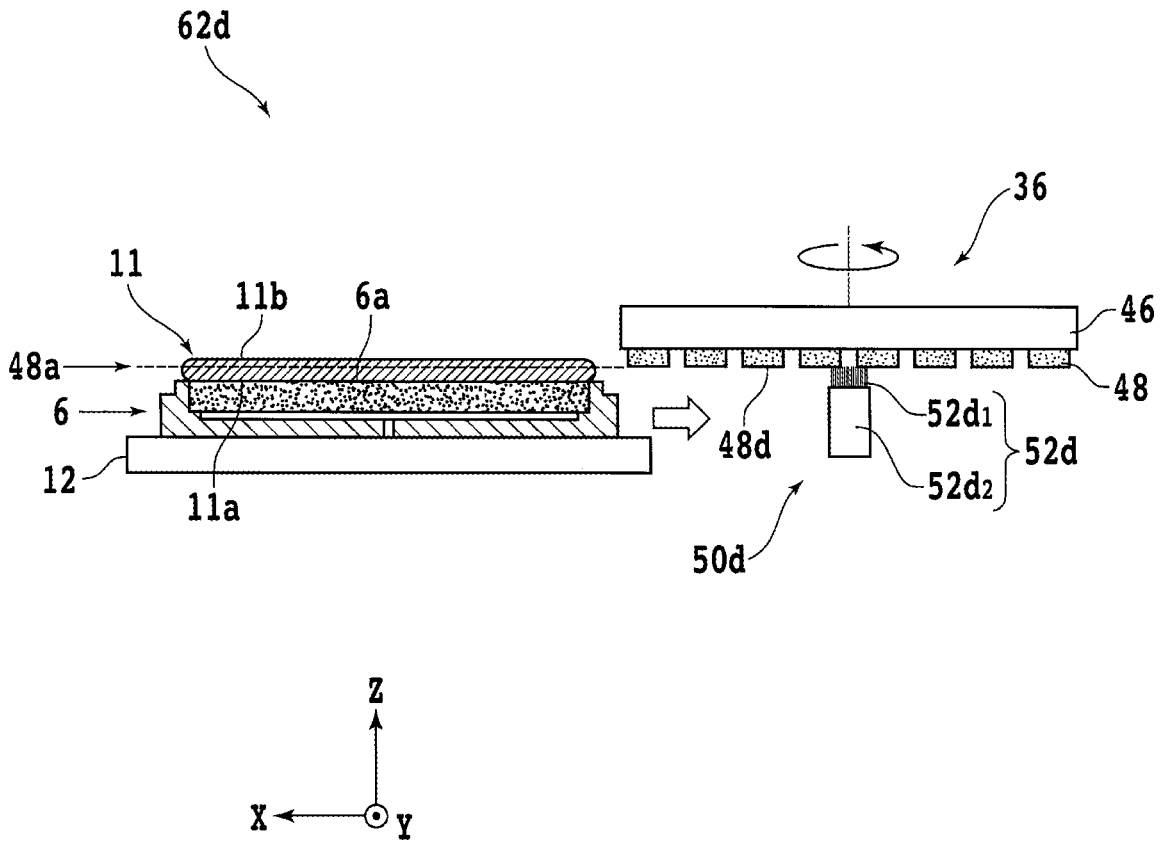
FIG. 11 is a side elevational view, partly in cross section, of a creep feed grinding apparatus according to a fifth embodiment of the present invention.

A fifth embodiment of the present invention will be described below. FIG. 11 illustrates in side elevation, partly in cross section, a creep feed grinding apparatus 62*d* according to the fifth embodiment. The creep feed grinding apparatus 62*d* includes a bottom surface state adjusting unit 50*d*. The bottom surface state adjusting unit 50*d* has a brush, i.e., a bottom surface state adjusting mechanism, 52*d* whose relative position with respect to the grinding unit 36 is fixed. According to the fifth embodiment, the brush 52*d* is a tubular brush having bristles $\mathbf{52}d_1$ made of such resin as polyamide or polyester and a tube $\mathbf{52}d_2$ bundling up the lower ends of the bristles $\mathbf{52}d_1$. According to the present invention, the brush is not limited to a tubular brush, and may be any of brushes having other shapes.

The brush 52*d* illustrated in FIG. 11 is fixed to the base 4 at a position directly below the grinding surface 48*a* outside of the relative movement area B. The brush 52*d* is connected to an unillustrated lifting and lowering mechanism for selectively lifting and lowering the brush 52*d* along the Z-axis. When the creep feed grinding apparatus 62*d* starts to operate in the creep feed grinding mode, the lifting and lowering mechanism lifts the brush 52*d* to a lifted position in which the height or vertical position of upper ends of the bristles $\mathbf{52}d_1$ is aligned with the height or vertical position of the grinding surface 48*a*. When the creep feed grinding apparatus 62*d* is not grinding the workpiece 11, e.g., when the creep feed grinding apparatus 62*d* is serviced for maintenance, the lifting and lowering mechanism lowers the brush 52*d* to a predetermined lowered position out of contact with the bottom surfaces 48*d*.

According to the fifth embodiment, when the workpiece 11 is ground by the grinding wheel 44 in the creep feed grinding mode, the brush 52*d* is held in contact with the bottom surfaces 48*d* of the grindstones 48, thereby cleaning and/or correcting the bottom surfaces 48*d*. Thus, it is possible to at least remove grinding debris or swarf from the grindstones 48, dress the grindstones 48, or correct the shape of the grindstones 48 at the bottom surfaces 48*d* thereof. Consequently, a grindstone condition failure of the bottom surfaces 48*d* can be eliminated without a reduction in the efficiency of grinding in the creep feed grinding mode.

In FIG. 11, the single brush 52*d* is disposed directly below the grinding surface 48*a* outside of the relative movement area B. However, two or more brushes 52*d* may be disposed directly below the grinding surface 48*a*. Further, two or more brushes 52*d* may be disposed outside of the relative movement area B on one side or respective both sides thereof along the Y-axis. In particular, if two brushes 52*d* are disposed diametrically across the center 48*c* on the outside diameter 48*b* of the grinding surface 48*a*, then as described above, the degree of freedom of the spindle 40 can be secured. The first modification or the second modification described above is also applicable to the creep feed grinding apparatus 62*d* according to the fifth embodiment.

Figure 12:
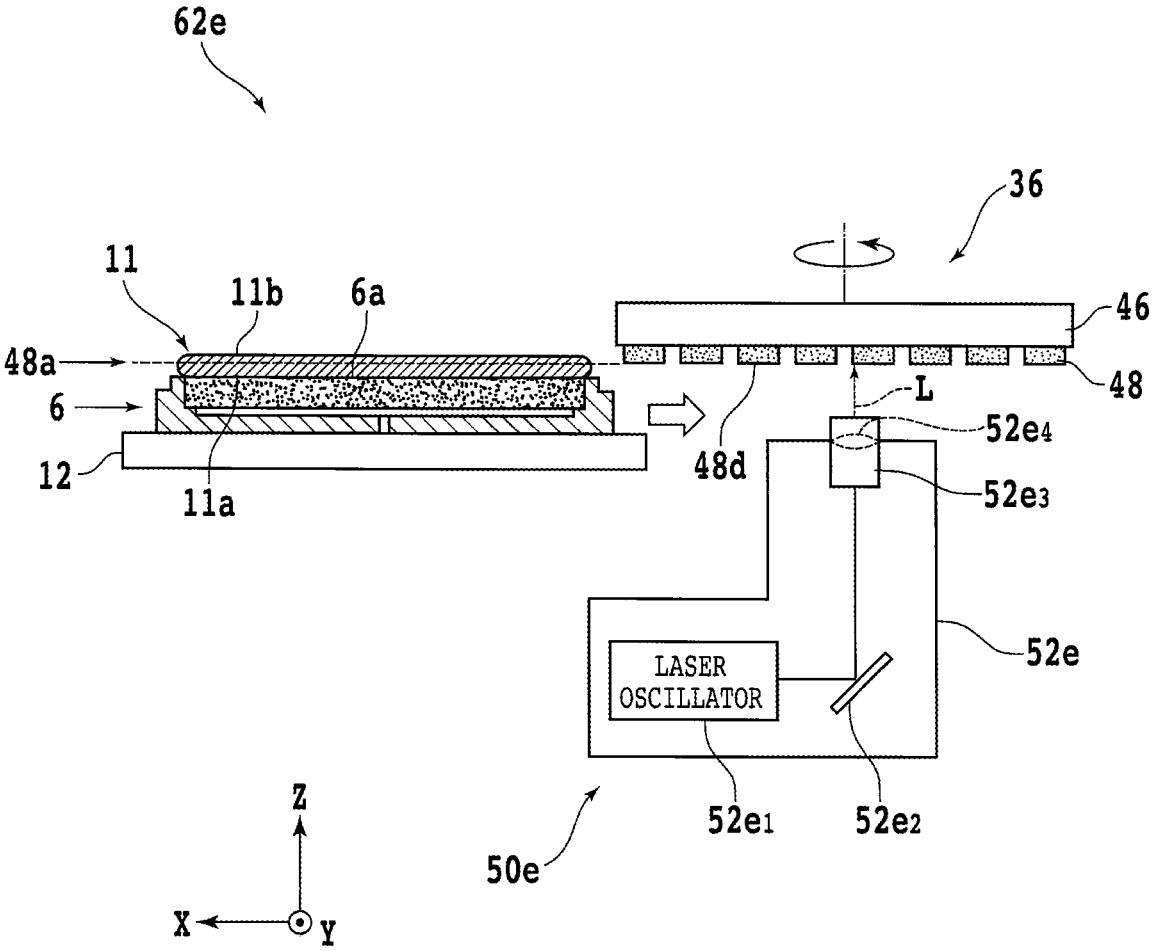
FIG. 12 is a side elevational view, partly in cross section, of a creep feed grinding apparatus according to a sixth embodiment of the present invention.

A sixth embodiment of the present invention will be described below. FIG. 12 illustrates in side elevation, partly in cross section, a creep feed grinding apparatus 62*e* according to the sixth embodiment. The creep feed grinding apparatus 62*e* includes a bottom surface state adjusting unit 50*e*. The bottom surface state adjusting unit 50*e* has a laser beam applying unit 52*e*. The laser beam applying unit 52*e* has a laser oscillator $\mathbf{52}e_1$ for emitting a pulsed laser beam L. The laser oscillator $\mathbf{52}e_1$ includes a laser diode for generating and emitting laser radiation and an unillustrated pulse generator for controlling pulse characteristics including a pulse duration, a repetitive frequency, etc. of the pulsed laser beam L.

The pulse generator controls the laser emission from the laser diode. The laser emission from the laser diode is amplified by a rare-earth-doped fiber, e.g., an ytterbium (Yb)-doped fiber, enabling the laser oscillator $\mathbf{52}e_1$ to emit the pulsed laser beam L that has a predetermined wavelength of 1030 nm, for example. The laser beam L emitted from the laser oscillator $\mathbf{52}e_1$ is reflected by a mirror $\mathbf{52}e_2$ and travels through by a lens $\mathbf{52}e_4$ in a beam condenser, i.e., a bottom surface state adjusting mechanism, $\mathbf{52}e_3$ that focuses the laser beam L onto the bottom surfaces 48*d* of the grindstones 48.

The lens $\mathbf{52}e_4$ is a cylindrical lens, for example. When the lens $\mathbf{52}e_4$ focuses the laser beam L onto the bottom surfaces 48*d*, the lens $\mathbf{52}e_4$ shapes the laser beam L into a horizontally linear beam having a length commensurate with the width of each of the grindstones 48, i.e., its dimension along the diameter of the grinding wheel 44. The beam condenser $\mathbf{52}e_3$ has a fixed relative position with respect to the grinding unit 36. The laser beam L shaped into the horizontally linear beam is applied to the bottom surfaces 48*d* in such a manner as to extend across the bottom surfaces 48*d* in radial directions of the grinding wheel 44, for example. The laser beam L focused as the horizontally linear beam on the bottom surfaces 48*d* is applied substantially uniformly to the bottom surfaces 48*d* in their entirety upon rotation of the grinding wheel 44 compared with a laser beam focused as a laser beam spot on the bottom surfaces 48*d*.

The laser beam applying unit 52*e* illustrated in FIG. 12 is fixed to the base 4, and the beam condenser $\mathbf{52}e_3$ is disposed directly below the grinding surface 48*a* outside of the relative movement area B. Laser processing conditions under which to process the workpiece 11 with the laser beam L emitted from the laser beam applying unit 52*e* are set as follows, for example:

Wavelength: 1030 nm

Repetitive frequency: 200 kHz

Pulse duration: 8 ps

Average output power: 30 W

According to the sixth embodiment, when the workpiece 11 is ground by the grinding wheel 44 in the creep feed grinding mode, the laser beam L emitted from the beam condenser $\mathbf{52}e_3$ is applied to the bottom surfaces 48*d* of the grindstones 48, thereby cleaning and/or correcting the bottom surfaces 48*d*. Specifically, the applied laser beam L melts or vaporizes the binder of the grindstones 48, grinding debris or swarf from the workpiece 11, etc., and gives energy to the abrasive grains of the grindstones 48. Thus, it is possible to at least remove grinding debris or swarf from the grindstones 48, dress the grindstones 48, or correct the shape of the grindstones 48 at the bottom surfaces 48*d* thereof. Consequently, a grindstone condition failure of the bottom surfaces 48*d* can be eliminated without a reduction in the efficiency of grinding in the creep feed grinding mode.

In FIG. 12, the single beam condenser $\mathbf{52}e_3$ is disposed directly below the grinding surface 48*a* outside of the relative movement area B. However, two or more beam condensers $\mathbf{52}e_3$ may be disposed directly below the grinding surface 48*a*. Further, two or more beam condensers $\mathbf{52}e_3$ may be disposed outside of the relative movement area B on one side or respective both sides thereof along the Y-axis. In particular, if two beam condensers $\mathbf{52}e_3$ are disposed diametrically across the center 48*c* on the outside diameter 48*b* of the grinding surface 48*a*, then as described above, the degree of freedom of the spindle 40 can be secured. The first modification or the second modification described above is also applicable to the creep feed grinding apparatus 62*e* according to the fifth embodiment.

The structure, method, etc., according to the above embodiments may be changed or modified appropriately without departing from the scope of the present invention. For example, the chuck table 6 may be of a rectangular plate shape rather than a circular plate shape. If the chuck table 6 is of a rectangular plate shape, then the holding surface 6*a* is a substantially flat rectangular surface. The workpiece 11 held under suction on the holding surface 6*a* is not limited to a circular plate wafer. The workpiece 11 may be a rectangular strip substrate including molded resin or the like. The workpiece 11 may be in a state of a frame unit including a plurality of strip substrates held on a frame ring by a protective tape, and each of the strip substrates may be ground by any of the creep feed grinding apparatuses according to the above embodiments in the creep feed grinding mode.

Different two of the bottom surface state adjusting units 50, 50*a*, 50*b*, 50*c*, 50*d*, and 50*e* may be used in combination. For example, the bottom surface state adjusting units 50 and 50*c* may be combined with each other. In such a combination, the first nozzle 52 is disposed in one of two locations spaced diametrically across the center 48*c* on the outside diameter 48*b* of the grinding surface 48*a* and the dresser $\mathbf{52}c_1$ is disposed in the other of the two locations. The high-pressure water 54 ejected from the first nozzle 52 and the dresser $\mathbf{52}c_1$ clean and/or correct the bottom surfaces 48*d*.

Particularly, the high-pressure water 54 is effective to remove grinding debris or swarf from the grindstones 48. The dressing of the grindstones 48 with the dresser $\mathbf{52}c_1$ is effective to dress and correct the shape of the grindstones 48. Therefore, the first nozzle 52 may be disposed in one of the locations where the grindstones 48 leave the workpiece 11, and the dresser $\mathbf{52}c_1$ may be disposed in the other location where the grindstones 48 start to grind the workpiece 11, as viewed in plan on the X-Y plane.

Alternatively, the bottom surface state adjusting units 50 and 50*d* may be combined with each other to clean and/or correct the bottom surfaces 48*d* with the high-pressure water 54 from the first nozzle 52 and the brush 52*d*. Further alternatively, the bottom surface state adjusting units 50 and 50*e* may be combined with each other to clean and/or correct the bottom surfaces 48*d* with the high-pressure water 54 from the first nozzle 52 and the laser beam L. Combinations of two of the bottom surface state adjusting units 50, 50*a*, 50*b*, 50*c*, 50*d*, and 50*e* other than the combinations described above may be used to clean and/or correct the bottom surfaces 48*d*. In addition, different three of the bottom surface state adjusting units 50, 50*a*, 50*b*, 50*c*, 50*d*, and 50*e* may be used in combination.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A creep feed grinding apparatus comprising:

a chuck table having a holding surface for holding a workpiece under suction thereon;

a grinding unit having a spindle rotatable about a longitudinal axis thereof and a grinding wheel mounted on a lower end of the spindle, the grinding wheel including an annular base and a plurality of grindstones disposed in an annular array on a surface of the annular base, the grinding wheel including an annular track having an outside diameter larger than a diameter of the chuck table, the grindstones being in the annular track;

a moving mechanism for moving the chuck table and the grinding unit relative to each other along a X-direction, which is perpendicular to the longitudinal axis of the spindle; and a bottom surface state adjusting mechanism for adjusting states of bottom surfaces of the grindstones by cleaning, correcting or cleaning and correcting the bottom surfaces of the grindstones that are held in contact with the workpiece on the holding surface when the grinding unit grinds the workpiece in a creep feed grinding mode, the bottom surface state adjusting mechanism having a longitudinal axis and being positioned below the annular track so that the longitudinal axis of the bottom surface adjusting mechanism is transverse to the bottom surfaces of the grindstones, wherein the bottom surface adjusting mechanism is positioned outside of a relative movement area of the chuck table in which the chuck table and the grinding unit are moved in the X-direction by the moving mechanism between a first position in which the chuck table is separated from the grinding wheel and a second position in which the chuck table is completely under the grinding wheel and the grindstones are contacting the workpiece, and the bottom surface adjusting mechanism is outside of the chuck table in the first position and the second position.

2. The creep feed grinding apparatus according to claim 1, wherein the bottom surface state adjusting mechanism has a nozzle for ejecting high-pressure water to the bottom surfaces of the grindstones when the grinding unit grinds the workpiece in the creep feed grinding mode.

3. The creep feed grinding apparatus according to claim 1, wherein the bottom surface state adjusting mechanism has a nozzle for ejecting high-pressure water including abrasive grains to the bottom surfaces of the grindstones when the grinding unit grinds the workpiece in the creep feed grinding mode.

4. The creep feed grinding apparatus according to claim 1, wherein the bottom surface state adjusting mechanism has a nozzle for ejecting a two-fluid mixture of water and air to the bottom surfaces of the grindstones when the grinding unit grinds the workpiece in the creep feed grinding mode.

5. The creep feed grinding apparatus according to claim 1, wherein the bottom surface state adjusting mechanism has a dresser configured for contacting the bottom surfaces of the grindstones when the grinding unit grinds the workpiece in the creep feed grinding mode.

6. The creep feed grinding apparatus according to claim 1, wherein the bottom surface state adjusting mechanism has a brush for contact with the bottom surfaces of the grindstones when the grinding unit grinds the workpiece in the creep feed grinding mode.

7. The creep feed grinding apparatus according to claim 1, wherein the bottom surface state adjusting mechanism has a laser beam applying unit including a beam condenser for applying a laser beam to the bottom surfaces of the grindstones when the grinding unit grinds the workpiece in the creep feed grinding mode.

8. The creep feed grinding apparatus according to claim 1, wherein the bottom surface state adjusting mechanism includes two nozzles disposed diametrically across the center on an outside diameter of a grinding surface of the grinding wheel and outside of a relative movement area of the chuck table.

9. The creep feed grinding apparatus according to claim 1, wherein the bottom surface state adjusting mechanism includes a nozzle that is disposed on a straight line parallel to a Y-axis and across a center of the workpiece on a X-Y plane.

10. The creep feed grinding apparatus according to claim 1, wherein the grinding unit is attached to a support structure, the support structure being attached to an X-axis moving mechanism that moves the support structure along the X-axis.

* * * * *